US010655259B2

(12) United States Patent
Jackson

(10) Patent No.: US 10,655,259 B2
(45) Date of Patent: May 19, 2020

(54) QUILT STAMPS

(71) Applicant: LaVonne Jackson, North Ogden, UT (US)

(72) Inventor: LaVonne Jackson, North Ogden, UT (US)

( * ) Notice: Subject to any disclaimer, the term of this patent is extended or adjusted under 35 U.S.C. 154(b) by 251 days.

(21) Appl. No.: 15/995,074

(22) Filed: May 31, 2018

(65) Prior Publication Data

US 2019/0368095 A1 Dec. 5, 2019

(51) Int. Cl.

| | |
|---|---|
| ***D05B 97/12*** | (2006.01) |
| ***D05B 91/06*** | (2006.01) |
| ***B43L 13/20*** | (2006.01) |
| ***A41H 3/01*** | (2006.01) |

(52) U.S. Cl.

CPC ..... *D05B 91/06* (2013.01); *A41H 3/01* (2013.01); *B43L 13/205* (2013.01); *D05B 97/12* (2013.01)

(58) Field of Classification Search

CPC ..... D05B 91/06; D05B 97/12; B43L 13/20; B43L 13/201; B43L 13/205; A41H 3/00; A41H 3/01; A41H 3/065

USPC ..... 33/563, 562, 565, 566, 34–39.2

See application file for complete search history.

(56) References Cited

U.S. PATENT DOCUMENTS 3,529,361 A * 9/1970 Parsons, Jr. ..... B27M 3/00 33/562
4,053,986 A * 10/1977 Axelrod ..... D04D 7/02 33/17 R
4,230,164 A * 10/1980 Mericle ..... B23Q 35/42 144/144.1
4,563,154 A * 1/1986 Vandervort ..... B43L 13/203 33/565
4,924,594 A * 5/1990 Fernandes ..... B26B 29/06 269/1
4,930,382 A * 6/1990 Collins ..... A41H 3/00 33/17 R
4,945,642 A * 8/1990 Saulietis ..... A41H 31/00 33/12
5,105,551 A * 4/1992 McCutchen ..... B43L 13/205 101/127
6,276,070 B1 * 8/2001 Hawley ..... B43L 7/033 33/1 G
6,901,672 B1 * 6/2005 Reilly ..... G01B 3/30 33/501.45
7,543,388 B2 * 6/2009 Christensen ..... E04F 21/003 33/194
2008/0052940 A1 * 3/2008 Manley ..... D04B 31/00 33/563

FOREIGN PATENT DOCUMENTS

DE 102013103809 A1 * 10/2014 ..... A41H 3/002

* cited by examiner

*Primary Examiner* — Christopher W Fulton
(74) *Attorney, Agent, or Firm* — Kirton McConkie; Brian Tucker

(57) ABSTRACT

A quilt stamps and quilt stamp sets can be used to simplify and expedite the process of cutting and sewing fabric pieces for a patchwork quilt. A quilt stamp can be formed of a transparent material in a desired shape. A stamping side of the quilt stamp includes parallel ridges that are offset from and extend along the outer edges of the shape. The outer ridge can be formed as a continuous ridge while the inner ridge can include repeating gaps thereby forming a dashed pattern. Both the outer and inner ridges can function to stamp lines onto fabric which define where to cut as well as where to sew the fabric.

20 Claims, 4 Drawing Sheets

QUILT STAMPS

CROSS-REFERENCE TO RELATED APPLICATIONS

N/A

BACKGROUND

Quilting is the process of sewing two or more layers of fabric together to form a quilt. These layers typically include the quilt top, batting and backing material. A patchwork quilt is a type of quilt having a quilt top that is formed of pieces of fabric sewn together in a desired design. When pieces of complex shapes and sizes are employed, the sewing of the quilt top can be quite difficult. To address such difficulties, a technique known as English paper piecing can be employed.

As the name implies, English paper piecing employs stiff paper templates to create fabric pieces in the desired shape. Initially, the fabric pieces are cut larger than the desired shape. Then, the paper template is centered on and secured to the fabric (e.g., using glue), and the edges of the fabric are wrapped around and temporarily secured to the paper template thereby forming the desired shape and leaving a seam allowance. The fabric pieces can then be sewn together after which the paper templates can be removed. Although English paper piecing can produce precise patterns, it is a rather intricate and tedious process.

BRIEF SUMMARY

The present invention is directed to quilt stamps and quilt stamp sets that can be used to simplify and expedite the process of cutting and sewing fabric pieces for a patchwork quilt. A quilt stamp configured in accordance with the present invention can be formed of a transparent material in a desired shape. A stamping side of the quilt stamp includes parallel ridges that are offset from and extend along the outer edges of the shape. The outer ridge can be formed as a continuous ridge while the inner ridge can include repeating gaps thereby forming a dashed pattern. Both the outer and inner ridges can function to stamp lines onto fabric which define where to cut as well as where to sew the fabric.

An adhering side of the quilt stamp, which is opposite the stamping side, can be configured to selectively adhere to a transparent stamping block. In this way, a number of quilt stamps of varying shapes and sizes can be selectively adhered to the stamping block. Because the stamping block and the quilt stamps are formed of transparent material, the user will be able to see the fabric as the fabric is being stamped thereby facilitating the positioning of the stamped lines in the desired location. The dashed pattern of the inner ridge will cause the inner stamped line to have a dashed pattern thereby reducing the amount of ink on the fabric and clearly representing where to sew.

In one embodiment, the present invention is implemented as a quilt stamp that comprises a transparent material having outer edges defining a shape, a stamping side and an adhering side opposite the stamping side. The adhering side forms an adhesive surface to enable the quilt stamp to be selectively adhered to a stamping block. The stamping side includes an outer ridge that extends along the outer edges and an inner ridge that is inwardly offset from and extends along the outer ridge.

In another embodiment, the present invention is implemented as a set of quilt stamps each of which comprises a transparent material having outer edges defining a shape, a stamping side and an adhering side opposite the stamping side. The adhering side forms an adhesive surface to enable the quilt stamp to be selectively adhered to a stamping block. The stamping side includes an outer ridge that extends along the outer edges and an inner ridge that is inwardly offset from and extends along the outer ridge.

In another embodiment, the present invention is implemented as a quilt stamp formed of a transparent, flexible and adhesive material having outer edges defining a shape, a stamping side and an adhering side opposite the stamping side. The adhering side forms an adhesive surface to enable the quilt stamp to be selectively adhered to a stamping block. The stamping side includes an outer ridge that is inwardly offset from and extends along the outer edges and an inner ridge that is inwardly offset from and extends along the outer ridge, the inner ridge including a plurality of gaps.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

A quilt stamp configured in accordance with embodiments of the present invention can facilitate cutting and sewing of fabric pieces for a patchwork quilt or similar type of fabric article. The quilt stamp of the present invention overcomes many of the difficulties that exist with English paper piecing and other methods for cutting and sewing fabric pieces.

Figure 1:
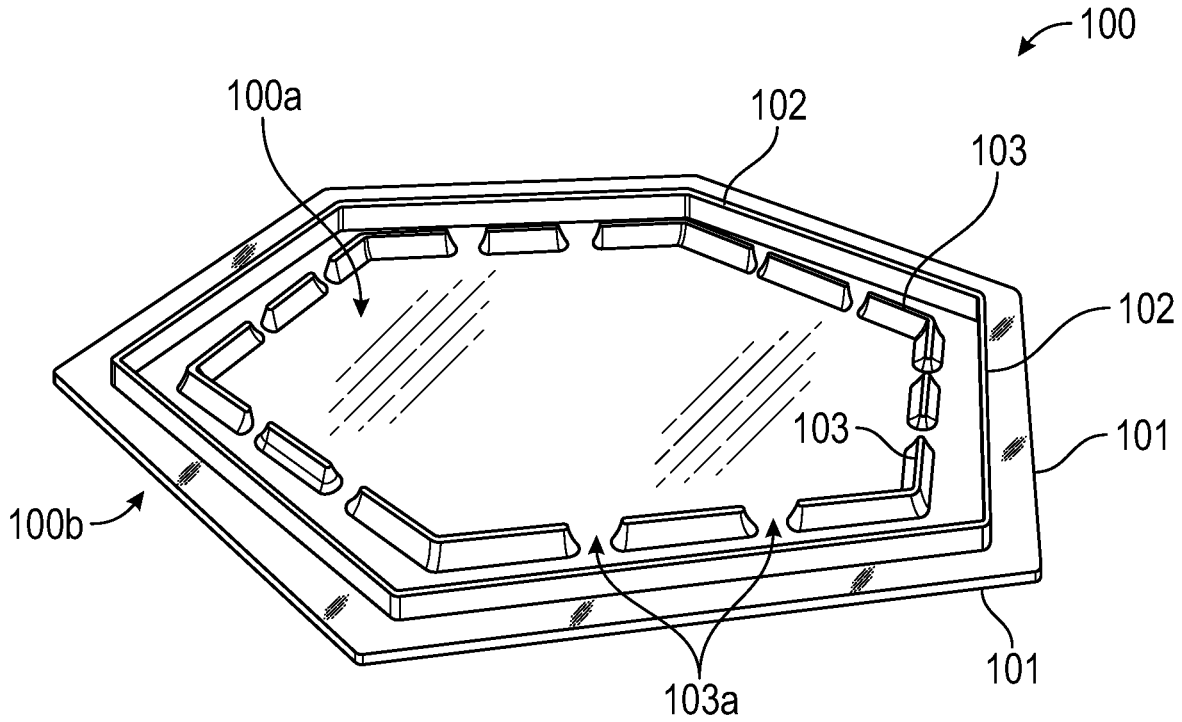
FIG. 1 provides a bottom perspective view of a quilt stamp that is configured in accordance with embodiments of the present invention.

FIG. 1 illustrates an example of a quilt stamp 100. Quilt stamp 100 can be formed of a transparent material, and preferably of a transparent, pressure-sensitive adhesive and elastic material such as an acrylic polymer. Quilt stamp 100 has outer edges 101 that define its shape. In this example, quilt stamp 100 has a hexagonal shape and would therefore be used to create hexagonal fabric pieces.

Quilt stamp 100 includes a stamping side **100*a* (which may be considered a bottom side) and an adhering side 100*b* opposite stamping side 100*a*. Adhering side 100*b* is generally flat and adhesive to thereby allow quilt stamp 100 to be selectively adhered to a stamping block as will be further described below. This adhesiveness could be accomplished by forming quilt stamp 100 of a pressure-sensitive adhesive material as indicated above or by applying an adhesive material to adhering side 100*b*. Stamping side 100*a* is also generally flat but includes parallel ridges that extend along outer edges 101. For example, as shown, an outer ridge 102** can extend continuously along and parallel with outer edges 101. However, in some embodiments, outer ridge 102 could be positioned at outer edges 101.

An inner ridge 103 also extends along and parallel with outer edges 101 but is inwardly offset from outer ridge 102. The amount of this offset defines the seam allowance and therefore may typically be ¼ inch, ½ inch or another standard-sized seam allowance. Inner ride 103 includes a number of gaps (or discontinuities) 103*a* which cause inner ridge 103 to have a dashed pattern. As shown, gaps 103*a* can be positioned away from any corners 103*b* in inner ridge 103 so that each corner 103*b* will be continuous.

Figure 2:
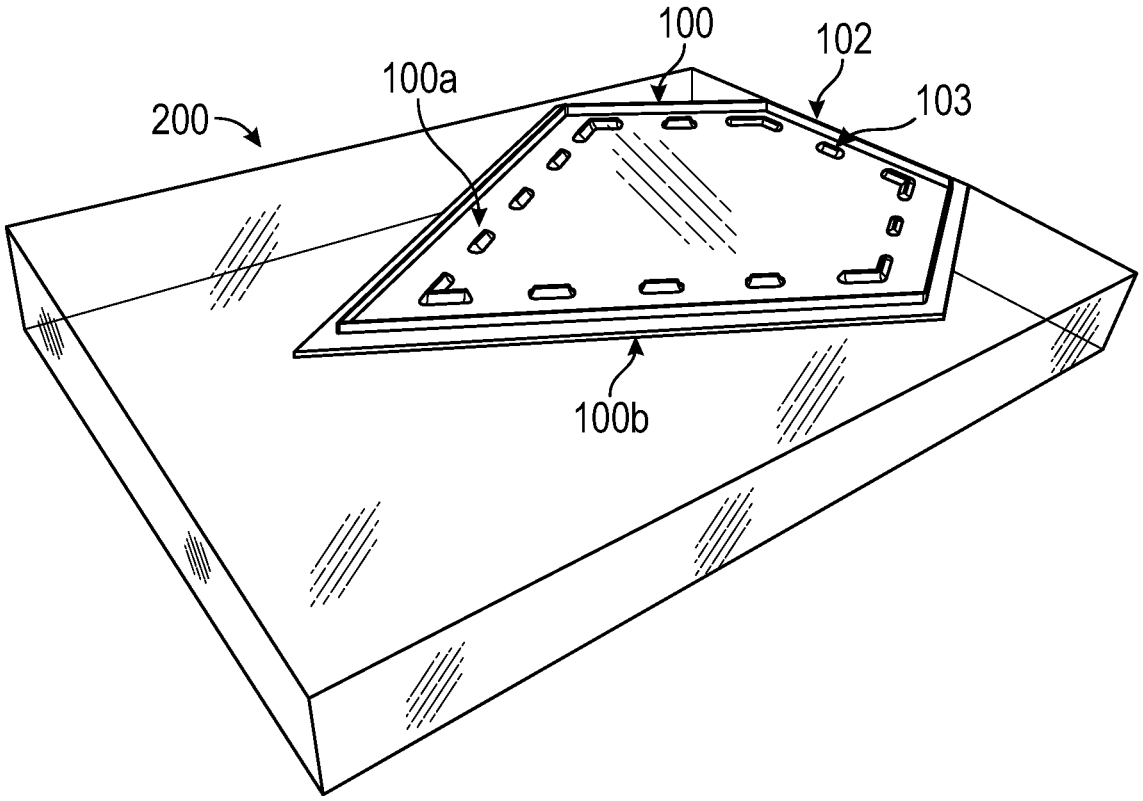
FIG. 2 provides a bottom perspective view of a quilt stamp that has been adhered to a stamping block.
Figure 3:
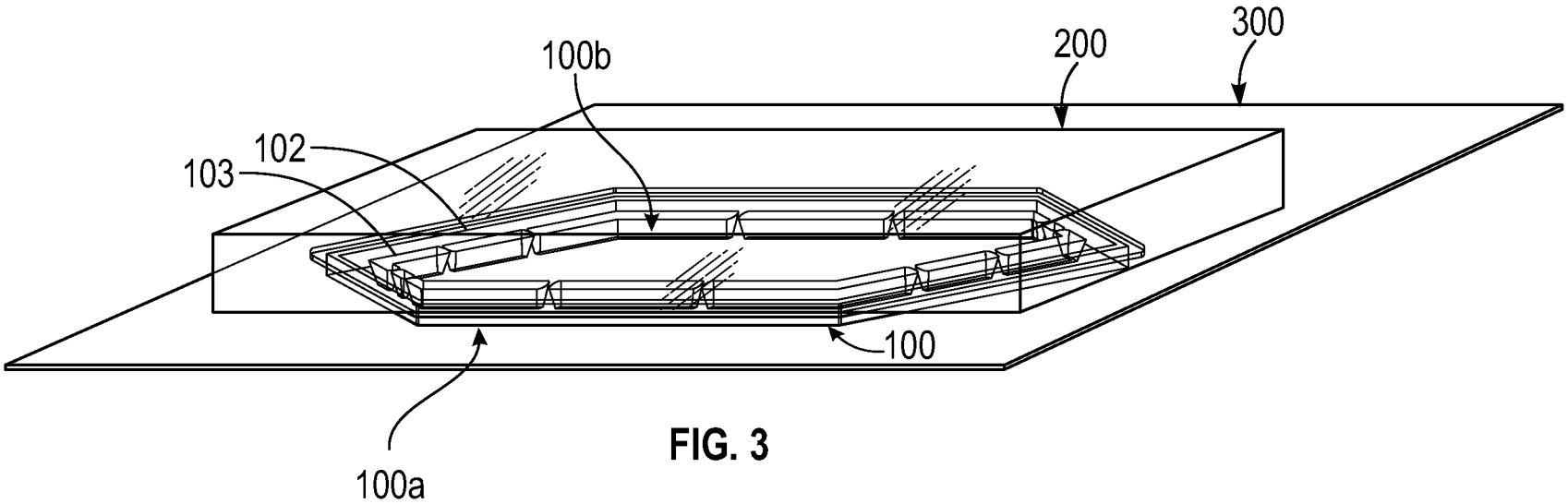
FIG. 3 provides a top perspective view of a quilt stamp and stamping block while they are stamping fabric.

FIG. 2 illustrates an example where a quilt stamp 100 has been selectively adhered to a stamping block 200. Like quilt stamp 100, stamping block 200 can be formed of a transparent material such as an acrylic glass. Adhering side 100*b* can be placed against stamping block 200 so that stamping side 100*a* faces outwardly. Then, ink can be applied to outer ridge 102 and inner ridge 103 at which point, stamping side 100*a* can be placed against the fabric 300 to stamp corresponding lines on the fabric as is represented in FIG. 3. Notably, because stamping block 200 and quilt stamp 100 are formed of transparent material, the user will be able to see through both stamping block 200 and quilt stamp 100 while stamping. In this way, the user can identify precisely where the stamped lines will be on the fabric resulting in more accurate patterns and less wasted fabric. This visibility also allows the stamping to be performed more quickly.

By configuring inner ridge 103 with gaps 103*a*, less ink will be stamped onto the fabric which can minimize bleeding and reduce overall costs. The dashed line that is created by inner ridge 103 also provides a clear indication of where to sew. Furthermore, because gaps 103*a* are spaced away from corners 103*b*, the dashed line will still clearly identify where the corners of the fabric piece are located. In contrast, the continuous outer ridge 102 will form a continuous line that defines where to cut the fabric. Given that the fabric is oftentimes cut with scissors, this continuous line will facilitate a straight cut.

Figure 4:
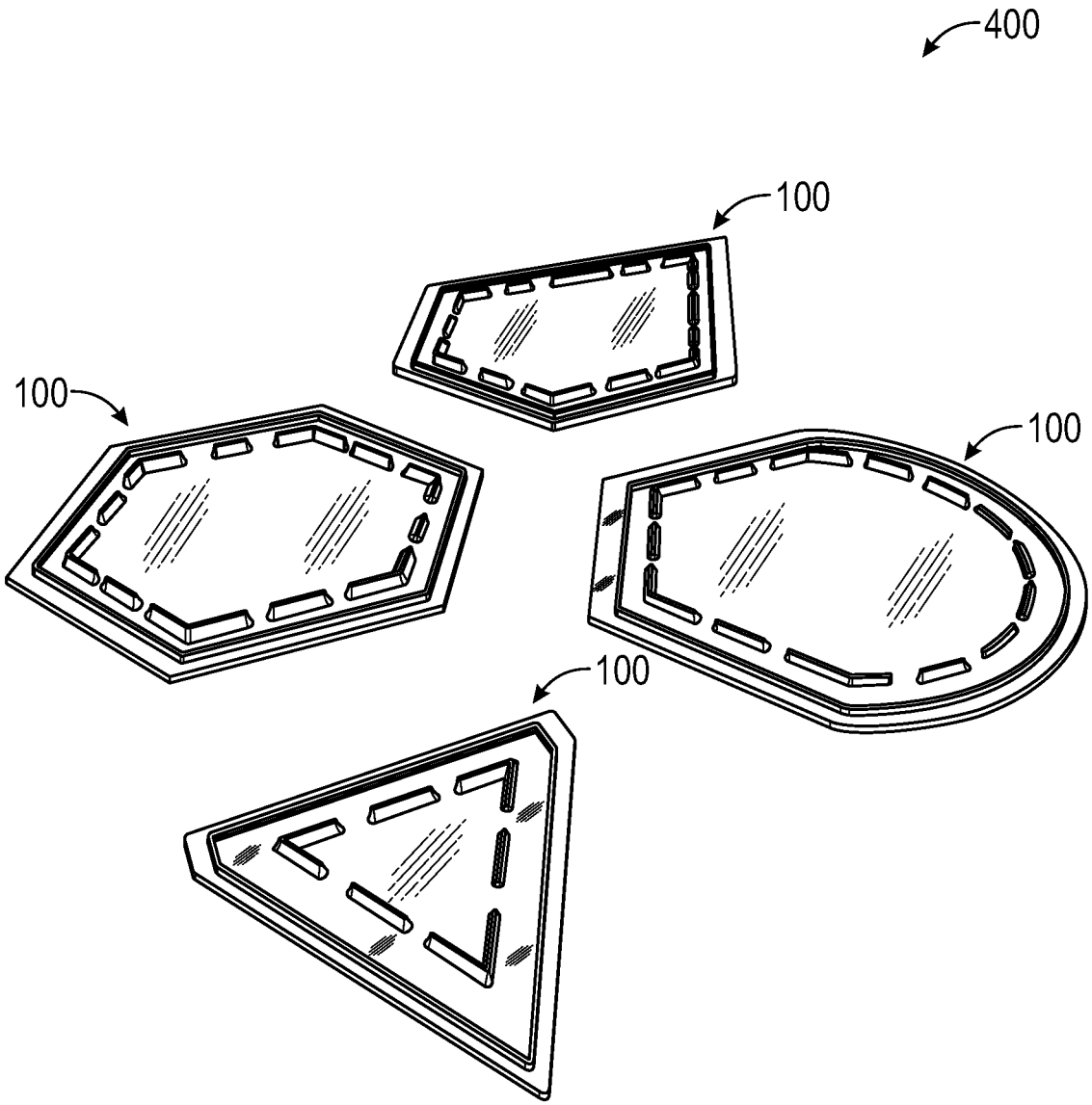
FIG. 4 provides a top perspective view of a set of quilt stamps.

As shown in FIG. 4, a set 400 of quilt stamps 100 of various shapes and sizes can be provided. Each quilt stamp 100 in set 400 can be selectively adhered to stamping block 200 as shown in FIG. 2 when it is desired to stamp the fabric with the corresponding shape. With outer ridge 102 inwardly offset from outer edges 101, the user can quickly and easily separate adhering side 100*b* from stamping block 200 to simplify shifting between different quilt stamps 100. More particularly, the thinner portion of quilt stamp 100 that extends beyond outer ridge 102 may be more flexible to facilitate inserting the fingernail or finger under quilt stamp 100 to commence peeling it away from stamping block 200. In some embodiments, set 400 can include stamping block 200 and/or hybrid ink.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A quilt stamp comprising:

a transparent material having outer edges defining a shape, a stamping side and an adhering side opposite the stamping side, the adhering side forming an adhesive surface to enable the quilt stamp to be selectively adhered to a stamping block;

wherein the stamping side includes an outer ridge that extends along the outer edges and an inner ridge that is inwardly offset from and extends along the outer ridge.

2. The quilt stamp of claim 1, wherein the transparent material comprises a flexible and adhesive acrylic.

3. The quilt stamp of claim 1, wherein the outer ridge is continuous.

4. The quilt stamp of claim 1, wherein the inner ridge includes a plurality of gaps.

5. The quilt stamp of claim 4, wherein the shape includes a number of corners such that the inner ridge also includes a corresponding number of corners, the gaps being spaced from the corners of the inner ridge.

6. The quilt stamp of claim 5, wherein the inner ridge includes two or more gaps between each adjacent pair of corners.

7. The quilt stamp of claim 1, wherein the outer ridge is inwardly offset from the outer edges.

8. The quilt stamp of claim 7, wherein the inward offset of the outer ridge remains constant around the outer edges.

9. The quilt stamp of claim 1, further comprising:

the stamping block, wherein the stamping block is formed of a transparent material.

10. A set of quilt stamps, wherein each quilt stamp comprises:

a transparent material having outer edges defining a shape, a stamping side and an adhering side opposite the stamping side, the adhering side forming an adhesive surface to enable the quilt stamp to be selectively adhered to a stamping block;

wherein the stamping side includes an outer ridge that extends along the outer edges and an inner ridge that is inwardly offset from and extends along the outer ridge.

11. The set of quilt stamps of claim 10, further comprising:

the stamping block, wherein the stamping block is formed of a transparent material.

12. The set of quilt stamps of claim 10, wherein the transparent material comprises an acrylic polymer.

13. The set of quilt stamps of claim 10, wherein the outer edges of each quilt stamp define a different shape.

14. The set of quilt stamps of claim 10, wherein the inner ridge of each quilt stamp includes a plurality of gaps.

15. The set of quilt stamps of claim 14, wherein the shape of each quilt stamp includes a number of corners such that the inner ridge also includes a corresponding number of corners, the gaps being spaced from the corners of the inner ridge.

16. The set of quilt stamps of claim 10, wherein the outer ridge of each quilt stamp is continuous.

17. The set of quilt stamps of claim 10, wherein the outer ridge of each quilt stamp is inwardly offset from the corresponding outer edges.

18. A quilt stamp comprising:

a transparent, flexible and adhesive material having outer edges defining a shape, a stamping side and an adhering side opposite the stamping side, the adhering side forming an adhesive surface to enable the quilt stamp to be selectively adhered to a stamping block;

wherein the stamping side includes an outer ridge that is inwardly offset from and extends along the outer edges and an inner ridge that is inwardly offset from and extends along the outer ridge, the inner ridge including a plurality of gaps.

19. The quilt stamp of claim 18, wherein the shape includes a number of corners such that the inner ridge also includes a corresponding number of corners, the gaps being spaced from the corners of the inner ridge.

20. The quilt stamp of claim 19, wherein the inner ridge includes two or more gaps between each adjacent pair of corners.

* * * * *